United States Patent [19]

Webinger

[11] 4,279,374

[45] Jul. 21, 1981

[54] ADHESIVE-FREE TRAY WITH INTERLOCKING TABS AND BLANK THEREFOR

[75] Inventor: George Webinger, Minneapolis, Minn.

[73] Assignee: Champion International Corporation, Stamford, Conn.

[21] Appl. No.: 93,927

[22] Filed: Nov. 13, 1979

[51] Int. Cl.[3] ..... B65D 5/22; B65D 45/22; B65D 85/36

[52] U.S. Cl. ..... 229/34 R; 229/DIG. 14; 426/113

[58] Field of Search ..... 229/34 R, DIG. 14; 206/622; 426/113

[56] References Cited

U.S. PATENT DOCUMENTS

| | | | |
|---|---|---|---|
| 783,913 | 2/1905 | Thompson | 229/34 R |
| 1,905,119 | 4/1933 | Newton | 229/34 R |
| 2,623,682 | 12/1952 | Candell | 229/34 R X |
| 2,707,587 | 5/1955 | Wittstein | 229/34 R |
| 2,788,932 | 4/1957 | German, Jr. | 229/34 R |
| 3,116,007 | 12/1963 | D'Esposito | 229/45 |
| 3,876,131 | 4/1975 | Tolaas | 229/22 |
| 3,949,931 | 4/1976 | Hall | 229/36 |
| 3,994,129 | 3/1976 | McCall | 229/DIG. 14 |
| 4,164,315 | 8/1979 | Pennanen | 229/34 R |

*Primary Examiner*—Davis T. Moorhead
*Attorney, Agent, or Firm*—Evelyn M. Sommer

[57] ABSTRACT

A tray formed of a unitary blank of paperboard for supporting food during a heating process. The tray comprises a bottom wall, two side walls, and two end walls with tabs interlocking the side and end walls. Tabs on the end walls project through slits in the bottom wall to form legs which support the wall in an elevated position. Interior flaps in the main wall lock the end wall tabs in place. The tray is set up without the use of adhesive. Apertures in the bottom wall allow fluid, such as water vapor in the form of steam escaping from the heated food, to flow through the tray.

2 Claims, 8 Drawing Figures

ADHESIVE-FREE TRAY WITH INTERLOCKING TABS AND BLANK THEREFOR

FIELD OF THE INVENTION

The present invention relates to a tray formed of a unitary blank of paperboard for supporting food, such as slices of frozen pizza, during a heating process. The tray has legs elevating the food supporting panel above the surface upon which it is placed and a plurality of apertures to allow fluid, such as water vapor, to flow therethrough. The tray has interlocking tabs and does not utilize adhesive.

Many different types of food, such as pizza, are now sold in the frozen state to be heated either in a conventional convection type oven or in a microwave oven just prior to consumption. Many different types of packaging have been proposed to contain these frozen foods and also to support these foods during the heating process. Many of these packages, however, are expensive to make due to materials and complex production methods. In addition, utilization of merely a flat tray as support during heating is not totally practical since many of these foods vent water vapor in the form of steam during the heating process which must be readily conducted away from the food or else it becomes soggy.

Accordingly, it is a primary object of the present invention to provide a tray which is formed from inexpensive materials in an inexpensive and uncomplicated manner so that food may be heated thereon in an oven.

Another object of the present invention is to provide a tray formed of a unitary blank of paperboard which may be stamped into the required shape.

Another object of the present invention is to provide a tray which can be set up without adhesive and which has interlocking flaps and tabs.

Another object of the present invention is to provide a tray having a plurality of apertures in the bottom panel thereof and a plurality of legs therefor to elevate the tray above the surface upon which it is placed during the heating process to allow fluid, such as water vapor in the form of steam, to flow therethrough.

The foregoing objects are basically attained by providing a unitary blank of paperboard adapted to form a tray comprising a main panel having a plurality of apertures therein and first and second cut lines, one of said cut lines located adjacent each end of the main panel; a first side panel hingedly coupled to a side edge of the main panel along a fold line and having a first pair of end tabs hingedly coupled along fold lines at opposed ends thereof; a second side panel hingedly coupled to the other side edge of the main panel along a fold line and having a second pair of end tabs hingedly coupled along fold lines at opposed ends thereof; a first end panel hingedly coupled to an end of the main panel along a fold line and having a fold line therein separating the first end panel into a first and second portion, the second portion having at least one tab extending therefrom; and a second end panel hingedly coupled to the other end of the main panel along a fold line and having a fold line therein separating the second end panel into a first and second portion, the second portion having at least one tab extending therefrom.

This unitary blank can easily be formed by a stamping process and is set up without adhesive by interlocking the end tabs on the side panels between the first and second portions of the end panels. In addition, the tabs on the end panels are received in and extend through the various cut lines in the main panel to provide legs which support the main panel above the surface upon which it is placed. Thus, any water vapor in the form of steam escaping from the food placed on the main panel can easily be vented through the apertures in the main panel. Interior flaps in the main panel lock the end panel tabs in their supporting position to assure maintenance of the elevated position.

Other objects, advantages and salient features of the present invention will become apparent from the following detailed description which, taken in conjunction with the annexed drawings, discloses a preferred embodiment of the present invention.

BRIEF DESCRIPTION OF THE DRAWINGS

Referring now to the drawings which form a part of this original disclosure.

DETAILED DESCRIPTION OF THE INVENTION

Figure 1:
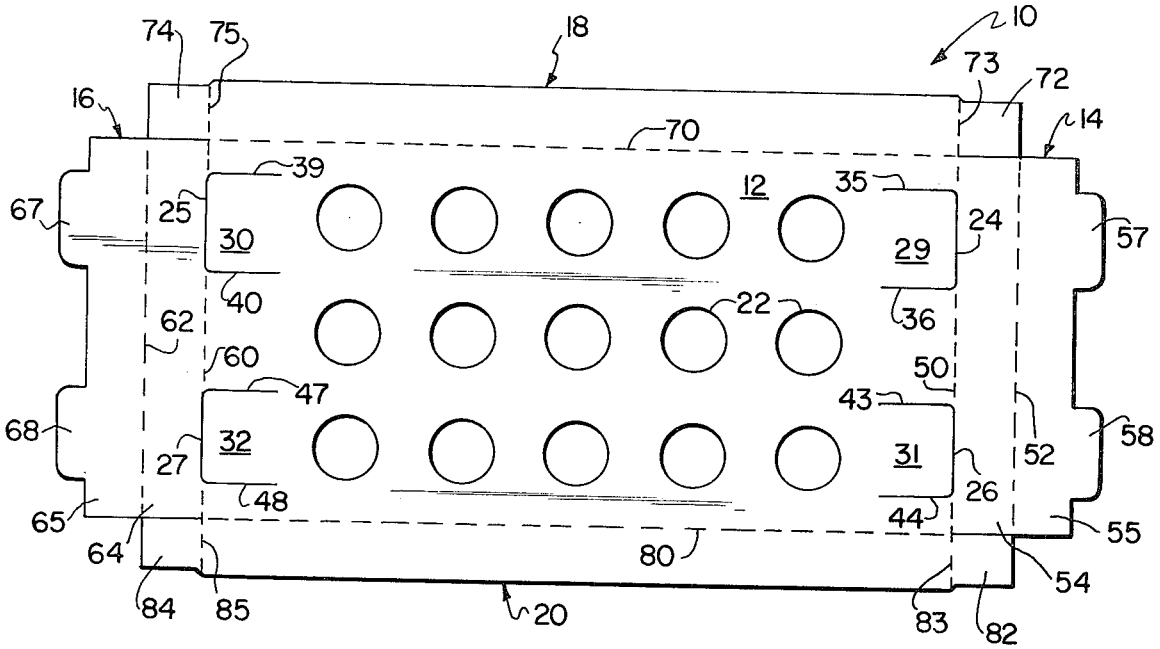
FIG. 1 is a top plan view of the unitary blank of paperboard forming the tray of the present invention.

Referring now to FIG. 1, the unitary blank 10 is shown comprised of a main panel 12, a first end panel 14, a second end panel 16, a first side panel 18 and a second side panel 20. The paperboard forming the unitary blank is preferably coated on both sides with polyethylene terephthalate to protect it during the heating process.

The main panel 12, which becomes the bottom wall for supporting the food once the tray is set up, includes a plurality of circular apertures 22 in an array consisting of three rows and five columns. These are evenly spaced in the center of the main panel 12. These apertures 22 provide a venting of water vapor in the form of steam from the food placed on the main panel during the heating process. The main panel 12 also has a first cut line 24, a second cut line 25, a third cut line 26 and a fourth cut line 27 formed therein as slits extending completely through the thickness thereof. The first and third cut lines 24 and 26 are located adjacent the first end panel 14 while the second and fourth cut lines 25 and 27 are located adjacent the second end panel 16. Located in the main panel and associated with each of the four cut lines is a pair of additional cut lines, each intersecting an end of the associated cut line at substantially right angles. This combination of three cut lines defines in substantially each corner of the rectnagular main panel 12 four interior flaps 29, 30, 31 and 32. These flaps aid in the setting up process of the tray and also lock the end panel tabs in their support position, as described hereinafter.

In particular, the first interior flap 29 is defined by the first cut line 24 and a first pair of additional cut lines 35 and 36. The second interior flap 30 is defined by the second cut line 25, and a second pair of additional cut lines 39 and 40. The third interior flap 31 is defined by the third cut line 26 and the third pair of additional cut lines 43 and 44. Finally, the fourth interior flap 32 is defined by the fourth cut line 27 and the fourth pair of additional cut lines 47 and 48. Each of these interior flaps has a substantially U-shaped outer configuration formed by the three cut lines.

The first end panel 14 is rectangular and is hingedly coupled to the first end of the main panel 12 along fold line 50, which as seen in FIG. 1 is coicident with and contains the first and second cut lines 24 and 26. An interior fold line 52 which is parallel to fold line 50 separates the first end panel 14 into a first portion 54 and a second portion 55, this second portion having two spaced tabs 57 and 58 extending from the outer edge thereof. The width of each tab 57 and 58 is slightly less than the length of the cut lines 24 and 26, which ultimately receive these tabs therein.

Similarly, the second end panel 16 is rectangular and is hingedly coupled along fold line 60 to the other, second end of main panel 12, this fold line 60 being coincident with cut lines 25 and 27. Separating the second end panel 16 into a first portion 64 and a second portion 65 is an interior fold line 62 which is parallel to fold line 60. On the exterior edge of the second portion 64 are two spaced tabs 67 and 68 which have a width slightly less than the length of the cut lines 25 and 27 which ultimately receive these tabs therein.

The first side panel 18 is hingedly coupled to a side edge of the main panel 12 along fold line 70 and has at opposed ends a first pair of end tabs comprising a first end tab 72 hingedly coupled along fold line 73 and a second end tab 74 hingedly coupled along fold line 75.

Similarly, the second side panel 20 is hingedly coupled on the other side edge of the main panel 12 along fold line 80 and has at opposed ends thereof a second pair of end tabs comprising an end tab 82 hingedly coupled along fold line 83 and end tab 84 hingedly coupled along fold line 85.

Figure 2:
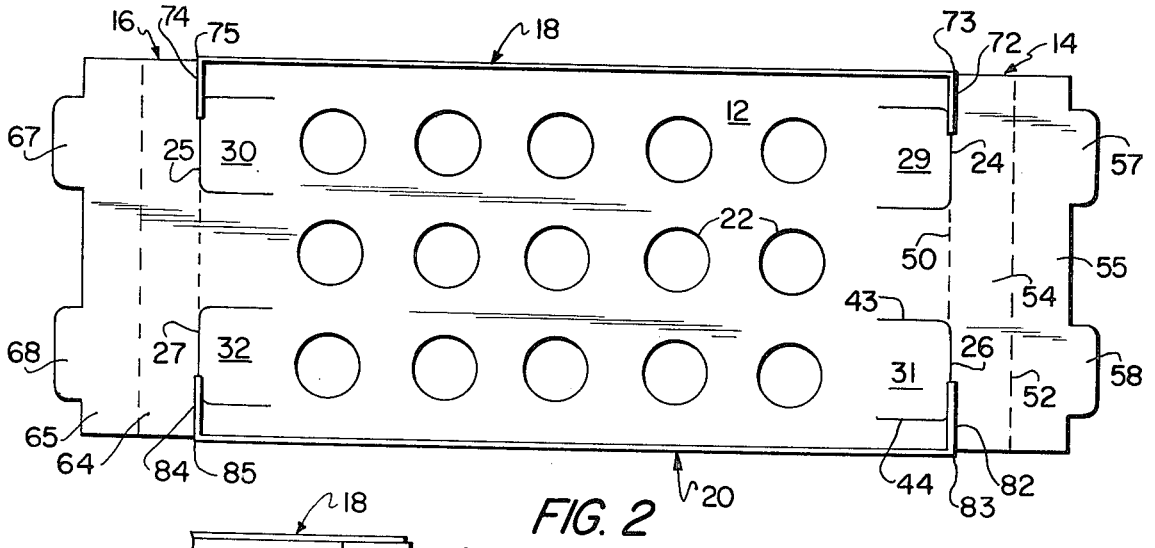
FIG. 2 is a top plan view of the blank shown in FIG. 1 except that the side panels have been folded perpendicular to the main panel and the end tabs on each side panel have been folded perpendicular to their respective side panels.

In order to set up the blank to form the tray of the present invention, the two side panels 18 and 20 are folded along their respective fold lines 70 and 80 so that they are perpendicular to the main panel 12, thereby forming side walls thereof. The end tabs 72 and 74 are folded along fold lines 73 and 75 so that they are perpendicular to the first side panel 18 and similarly end tabs 82 and 84 are folded along their fold lines 83 and 85 so that they are perpendicular to the second side panel 20. This configuration is shown in FIG. 2.

Figure 3:
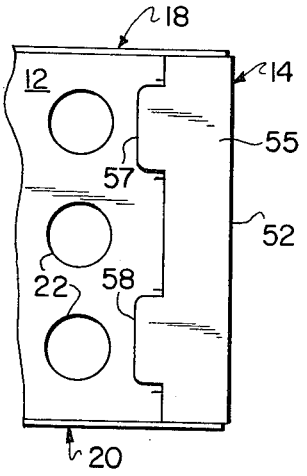
FIG. 3 is a top plan fragmentary view similar to that shown in FIG. 2 except that the end panel has been folded perpendicular to the main panel and a second portion of the end panel has been folded so that it is parallel to the main panel.

As seen in FIG. 3, the first end panel 14 is folded first along fold line 50 so that the first portion 54 is perpendicular to the main panel 12 and the second portion 55 is partially folded along interior fold line 52 so that it is substantially parallel to main panel 12. A similar folding action takes place for the second end panel 16.

Figure 4:
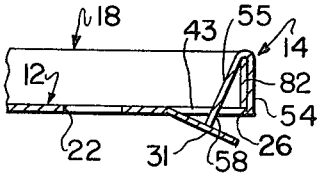
FIG. 4 is a fragmentary front elevational view in section through an interior flap and an end tab showing their relationship during setting up of the tray.
Figure 5:
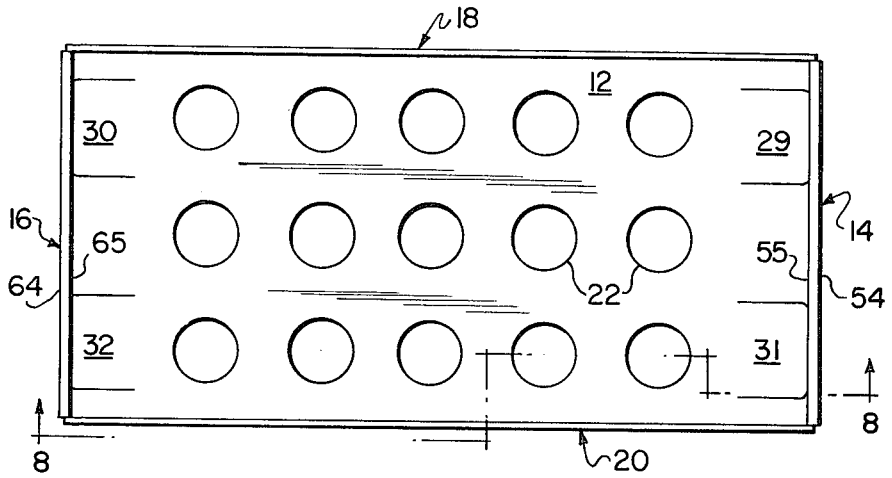
FIG. 5 is a top plan view similar to that shown in FIG. 2 except that the second portions of each of the end panels has been fully folded so that the first and second portions of each end panel are in a side-by-side relationship and the tabs thereon are received in and extend through cut lines in the main panel.
Figure 6:
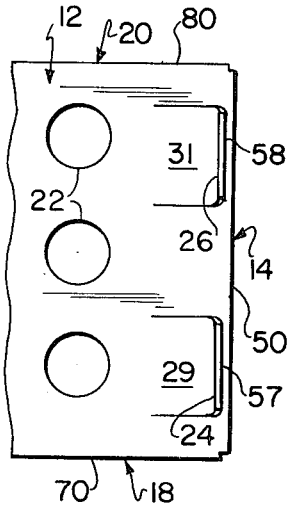
FIG. 6 is a bottom plan fragmentary view of the tabs extending through the main panel.
Figure 7:
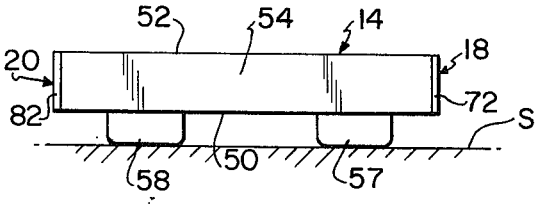
FIG. 7 is a right end view of the tray shown in FIG. 5.
Figure 8:
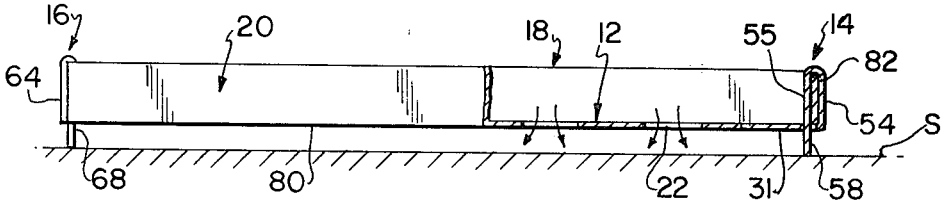
FIG. 8 is a front elevational view in section taken along lines 8—8 in FIG. 5 showing the interlocking tabs of the present invention and how the tray is elevated above the surface upon which it is placed.

The final folding operation to set up the tray, as seen in FIGS. 4–8, includes for the first end panel 14 a further folding of the second portion 55 thereof along fold line 52 so that the first portion 54 and the second portion 55 thereof are in side-by-side relationship, as seen in FIG. 8, with end tabs 72 and 82 on side panels 18 and 20 received and interlocked therebetween. In doing this, tabs 57 and 58 are pushed through respective cut lines 24 and 26 as specifically seen in FIGS. 6–8. These tabs 57 and 58 are not only received in these cut lines but also extend therethrough so as to form legs for the main panel to support it in elevated spaced relation to a surface S as seen in FIGS. 7 and 8 upon which the tray is placed to allow fluid flow through the apertures 22 as seen by the arrows in FIG. 8. To facilitate insertion of the tabs 57 and 58 into the cut lines 24 and 26 and also to maintain and lock these tabs therein, as seen in FIG. 4, the interior flaps 29 and 31 are pivoted downwardly during the folding operation of the second portion 55 along fold line 52. That is, these flaps are pivoted downwardly as the tabs 57 and 58 slide therealong and, once the first and second portions 54 and 55 are in side-by-side relationship, each of the flaps is pushed upwardly back into the plane containing the main panel 12, thereby locking the tabs in place. It should also be noted that the downward pivoting of the interior flaps allows the tabs to be received in the cut lines without bending of the tabs relative to the associated second portions of the end panels, thereby preventing a possible weakening of the tabs and a possible failure to support the tray in the elevated position.

A similar folding operation is carried on for the first and second portions 64 and 65 on the second end panel 16 and the tabs 67 and 68 associated therewith are received in and extend through the respective cut lines 25 and 27 in the main panel 12 as seen in FIG. 8. Thus, the tray is fully supported in the elevated position by the four tabs 57, 58, 67 and 68 which extend through the cut lines in the main panel 12. Portions 54 and 55 define the first end wall in the set up tray and portions 64 and 65 define the second end wall.

While one advantageous embodiment has been chosen to illustrate the invention, it will be understood by those skilled in the art that various changes and modifications can be made therein without departing from the scope of the invention as defined in the appended claims.

What is claimed is:

1. A unitary blank of paperboard adapted to be erected into a tray comprising:

a generally rectangular main panel having a plurality of apertures located therein;

a pair of opposed side panels respectively hingedly connected to opposed side edges of said main panel, with each said side panel including a pair of end tabs hingedly connected to the opposed ends of said side panel; and a pair of opposed end panels respectively hingedly connected to the opposed remaining edges of said main panel, with each said end panel including a fold line extending parallel to said hinged connection between said end panel and said main panel, said fold line dividing said end panel into first and second portions of equal width, with said first portion being disposed adjacent said main panel, and with each said end panel further including two standing tabs connected to the opposed free edge of said second portion, and wherein said main panel further includes two pairs of opposed locking tabs respectively disposed adjacent said opposed ends of said main panel, with each said pair of locking tabs being aligned with a pair of standing tabs of one of said end panels, with a portion of each said locking tab being defined by a first cut line, disposed coincident with said hinged connection between said main panel and said end panel, each said first cut line defining the locking edge of the associated locking tab, and with the remainder of each said locking tab being defined by a pair of spaced apart cut lines formed in said main panel and extending from the opposed ends of the associated first cut line and away from said end panel whereby when said tray is erected from said blank, said side panels are rotated into an upstanding position relative to said main panel, while said end tabs thereof are rotated perpendicular to the plane of said side panels and colinear with said hinged connection between said main panel and said end panels, whereupon each said end panel is rotated into an upstanding position about its hinged connection to said main panel such that said second portion may be further rotated inwardly and into coplanar relationship with said first portion, with said end tabs of said side panel being interposed between said first and second portions, said standing tabs being operative to bias said locking tabs downwardly enabling said standing tabs to project downwardly through the plane of said main panel and wherein after said folding is completed, the locking tabs are disposed in coplanar relationship with said main panel such that the locking edges thereof are disposed in frictional engagement with the associated end panel thereby structurally rigidifying said tray and preventing the unfolding of said end panels.

2. A tray formed from a unitary blank of paperboard comprising:

a generally rectangular bottom panel having a plurality of apertures located therein;

a pair of opposed upstanding side panels respectively hingedly connected to the opposed side edges of said main panel, each side panel including a pair of end tabs hingedly connected to the opposed ends thereof; and a pair of opposed upstanding end panels respectively hingedly connected to the opposed remaining edges of said main panel, each said end panel being formed of two hingedly connected coplanar portions, with the first portion thereof being hingedly connected to the associated end of said main panel and with the second portion being hingedly connected to the top edge of said first portion and being disposed inwardly relative to said first portion and with said end tabs of said side panels being interposed between said coplanar portions of said end panels, and with the bottom edge of said second portion including a pair of downwardly projecting standing tabs, said main panel further including two pairs of opposed locking tabs respectively disposed adjacent the opposed end of said main panel, with each said pair of locking tabs being aligned with a pair of standing tabs of each said end panel, with a portion of each said locking tab being defined by a first cut line, disposed coincident with said hinged connection between said main panel and said end panel, each said first cut line defining the locking edge of the associated locking tab, and with the remainder of each said locking tab being defined by a pair of spaced apart cut lines formed in said main panel, extending from the opposed ends of said associated first cut line and continuing away from said end panel such that during the erection of said tray from said blank, said locking tabs may be biased downwardly to enable said standing tabs to project downwardly through the plane of said bottom panel and wherein after said erection is completed, said locking tabs are disposed in coplanar relationship with said main panel such that the locking edges thereof are in frictional engagement with the associated end panel thereby structurally rigidifying said tray and preventing the unfolding of said end panels.

* * * * *